United States Patent [19]

Wolters

[11] Patent Number: 5,048,712

[45] Date of Patent: Sep. 17, 1991

[54] TREADLE TOP REFUSE CONTAINER

[76] Inventor: Richard H. Wolters, 3316 S. Creek Dr., SE., Grand Rapids, Mich. 49508

[21] Appl. No.: 421,373

[22] Filed: Oct. 13, 1989

[51] Int. Cl.[5] ..... B65F 1/16; B65D 43/26

[52] U.S. Cl. ..... 220/262; 220/263; 220/908; 248/134; 248/98

[58] Field of Search ..... 220/1 T, 262, 263; 248/97, 99, 134, 147, 907

[56] References Cited

U.S. PATENT DOCUMENTS

| | | | |
|---|---|---|---|
| 504,787 | 9/1893 | Kountz . | |
| 1,100,012 | 6/1914 | Dudgeon . | |
| 1,218,632 | 3/1917 | Derry | 248/147 |
| 1,500,964 | 10/1924 | Starks . | |
| 1,542,164 | 6/1924 | Nelson . | |
| 1,638,203 | 9/1926 | Jetel . | |
| 1,763,756 | 6/1930 | Casapollo | 220/263 |
| 1,937,337 | 11/1933 | Gaa | 220/263 |
| 2,096,506 | 10/1937 | Brandstrom . | |
| 2,533,524 | 12/1950 | Snider | 220/1 T |
| 2,811,329 | 10/1957 | Press et al. | 220/263 |
| 3,201,075 | 8/1965 | Sievers . | |
| 3,806,146 | 9/1974 | Shaw . | |
| 3,836,037 | 9/1974 | Bass . | |
| 3,838,839 | 10/1974 | Spencer | 248/99 |
| 4,200,197 | 4/1980 | Meyer et al. | 220/263 |
| 4,354,543 | 10/1982 | Bogner . | |
| 4,360,046 | 11/1982 | Streit et al. | 220/263 |
| 4,489,810 | 12/1984 | Curtis | 220/263 |
| 4,593,873 | 5/1986 | Nelson . | |
| 4,749,158 | 3/1988 | Buckley . | |
| 4,793,628 | 12/1988 | Haley, Sr. | 248/99 |
| 4,883,189 | 11/1989 | Lobbert | 220/1 T |

FOREIGN PATENT DOCUMENTS

| | | | |
|---|---|---|---|
| 2581628 | 11/1986 | France | 220/263 |
| 669445 | 4/1952 | United Kingdom | 248/147 |

*Primary Examiner*—Stephen Marcus
*Assistant Examiner*—S. Castellano
*Attorney, Agent, or Firm*—Price, Heneveld, Cooper, Dewitt & Litton

[57] ABSTRACT

A treadle top container for refuse and the like comprises a lower container member interconnected with an upper container member by an upright container member. The upright container member includes a hollow portion which communicates with a hollow portion of the lower container member and a hollow portion of the upper container member. A foot pedal is movably mounted adjacent to the lower container member while a lid is movably mounted adjacent to a rotatable portion of the upper container member. The lid is shaped to selectively close an open marginal edge of the upper container member. A flexible actuator is provided having one end operatively connected with the foot pedal and the other end operatively connected with a pivot rod located within and attached to the rotatable portion of the hollow portion of the upper container member. The flexible actuator is configured in such a manner such that shifting the foot pedal between a first and second position rotates the pivot rod, which rotates the rotatable portion of the hollow portion of the upper container member, and moves the lid between the open and closed positions. The actuator extends continuously from the foot pedal through the hollow portion of the lower container member, then through the hollow portion of the upright container member, and finally through the hollow portion of the upper container member to the pivot rod. The actuator is disposed wholly within the container to prevent damage to the actuator and to facilitate sanitation of the container.

19 Claims, 5 Drawing Sheets

TREADLE TOP REFUSE CONTAINER

FIELD OF THE INVENTION

This invention relates to a treadle top container for refuse and the like, more particularly, to a lift top container for refuse and the like.

BACKGROUND OF THE INVENTION

Containers with lids are common, and various mechanisms are used to attach lids to containers which allow the lids to be opened and closed. The most common method of attaching a lid to a container is by means of an ordinary common hinge. A problem associated with this method of hinging is that the hinges are exposed, and tend to corrode when constructed of metal, and also protrude rearward, potentially causing damage to walls and other surfaces and objects they are prone to hit. In an effort to provide materials that will not corrode, plastic hinges have been used. While plastic hinges do not rust, they are prone to breakage, especially in dry areas where the plastic dries out and becomes brittle Another problem associated with the use of hinges is that the connection between the hinge and the members upon which they are mounted is subject to breakage because hinges tend to concentrate stress. This concentration of stress eventually causes stress failure of the hinges which shortens the useful life of the containers. The appearance of hinges is also less than desirable and often causes concern with customers as to the strength and appearance of the container and its lid.

Containers with lids that are foot pedal actuated are also common, and various mechanisms are used to open and close such lids. Most foot pedal actuated mechanisms are built external to the container frame. One of the problems associated with this external location of the actuator mechanism is that those parts can collect dirt and debris and are difficult to clean, and thus become a harbor for bacteria. A further problem is that the exposed parts can catch on collection bags or containers or the collection bags or containers can catch and render the mechanism inoperable or difficult to use. An additional problem with externally mounted foot actuator mechanisms is the clashing of parts caused by the backlash upon actuation.

Hence, although containers with foot actuated lids are common, the various mechanisms which are used to open and close such lids are vulnerable to breakage and render the appearance of the container less than desirable, among other problems. As a result, there exists a need in the art for an improved device that will have no exposed parts, and otherwise overcome those above noted problems associated with prior art devices.

SUMMARY OF THE INVENTION

One aspect of the present invention is to provide a treadle top container for refuse and the like, wherein the container is comprised of a lower container member, a portion of which is hollow, shaped to support the container on a floor surface. The container also has an upper container member which is shaped to define an open marginal edge through which various articles are able to pass into and out of the container. This upper container member also has a hollow portion located therein. An upright container member interconnects the lower container member with the upper container member. This upright container member also includes a hollow portion which communicates with the hollow portion of the lower container member and also communicates with the hollow portion of the upper container member. A foot pedal is movably mounted adjacent to the lower container member. A lid, which is movably mounted adjacent to the upper container member, is shaped to selectively close the open marginal edge of the upper container member. The lid is also adapted to move with respect to the upper container member between the open and closed positions. A flexible actuator, one end of which is operatively connected with the lid, and the other end of which is operatively connected to the foot pedal, is configured in such a manner that shifting the foot pedal between a first and second position moves the lid between the open and closed positions. This actuator extends continuously from the foot pedal through the hollow portion of the lower container member through the hollow portion of the upright container member and through the hollow portion of the upper container member to the lid whereby the actuator is disposed wholly within the container to prevent damage to the actuator. This location of the actuator wholly within the container also facilitates sanitation of the container.

Another aspect of the present invention is to provide a treadle top container for refuse and the like, wherein a pivot rod rotatably mounts the lid on an upper container member to allow the lid to pivot between open and closed positions. The pivot rod is fixed to the lid so that when the lid rotates the pivot rotates as well with the lid. The opposite ends of the pivot rod are disposed adjacent to first and second segments of the upper container member. The opposite ends of the pivot rod are connected with the first and second container segments in a manner which permits the pivot rod and the lid to rotate between the open and closed positions yet, at the same time, interconnect the first and second segments of the upper container member to provide structural rigidity to the container.

In one embodiment of the present invention, a flexible actuator is provided, having one end operatively connected with the pivot rod and the other end operatively connected with the foot pedal. The flexible actuator is configured in such a manner such that shifting the foot pedal between the first and second positions rotates the pivot rod and moves the lid between the open and closed positions. The actuator extends continuously from the foot pedal through the hollow portion of the lower container member, then through the hollow portion of the upright container member, and finally through the hollow portion of the upper container member to the pivot rod. The actuator is disposed wholly within the container to prevent damage to the actuator and to facilitate sanitation of the container.

The invention has numerous advantages over prior foot pedal actuation and hinging mechanisms. The internal foot pedal actuator and hinging mechanisms have no exposed parts which can collect dirt and debris. Since these exposed parts are difficult to clean and thus often become a harbor for bacteria the present invention provides an improvement over prior art devices. Furthermore, these internal mechanisms have no exposed parts that can catch on collection bags or containers which would either rip open the bags resulting in their contents being spilled or which would render the mechanism inoperable or difficult to use. The use of these internal mechanisms also means that there is reduced noise which is caused by parts rattling on transportation of the container, or parts clashing caused by backlash upon actuation. Aesthetically, the lack of exposed parts gives the container the clean lines that one expects of a solidly built product.

These and other objects, advantages, purposes and features of the invention will become more apparent from a study of the following description taken in conjunction with the drawings.

DETAILED DESCRIPTION OF THE PREFERRED EMBODIMENTS

Figure 1:
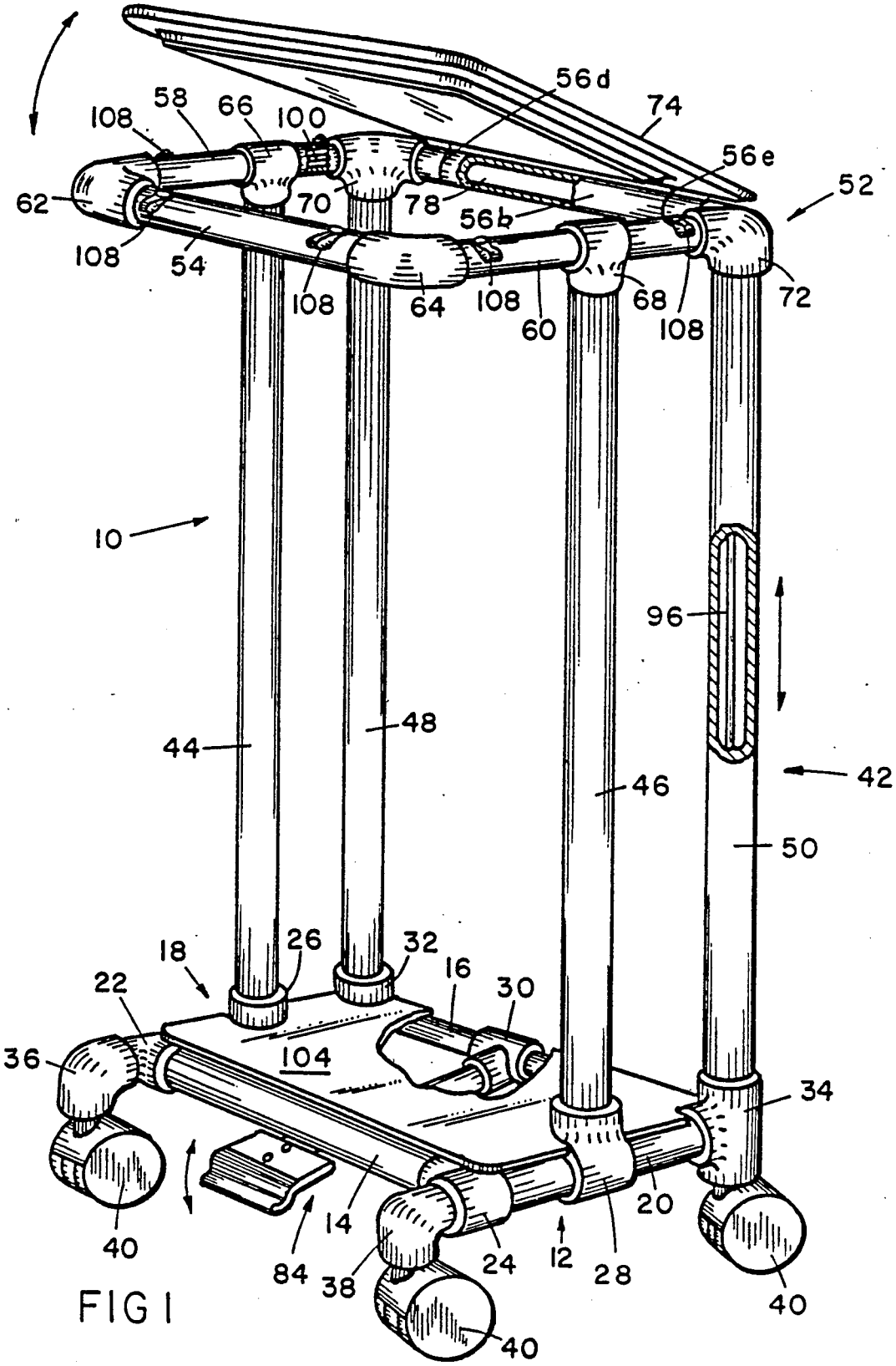
FIG. 1 is a perspective view of a lift top container embodying the present invention, wherein portions thereof have been broken away to reveal internal construction.

For purposes of description herein, the terms "upper", "lower", "right", "left", "rear", "front", "vertical", "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiment disclosed herein are not to be considered as limiting, unless the claims expressly state otherwise.

A treadle top container for refuse and the like comprises a lower container member interconnected with an upper container member by an upright container member. Refuse includes trash, dirty clothing, contaminated or used needles, dressings, or other medical or surgical instruments, or other dirty or contaminated items. In addition to holding refuse, the container may also be utilized to keep articles clean in a dirty environment. The upright container member includes a hollow portion which communicates with a hollow portion of the lower container member and a hollow portion of the upper container member. A foot pedal is movably mounted adjacent to the lower container member while a lid is movably mounted adjacent to a rotatable portion of the upper container member. The lid is shaped to selectively close an open marginal edge of the upper container member. A flexible actuator is provided having one end operatively connected with the foot pedal and the other end operatively connected with a pivot rod located within and attached to the rotatable portion of the hollow portion of the upper container member. The flexible actuator is configured in such a manner such that shifting the foot pedal between a first and second position rotates the pivot rod, which rotates the rotatable portion of the hollow portion of the upper container member, and moves the lid between the open and closed positions. The actuator extends continuously from the foot pedal through the hollow portion of the lower container member, then through the hollow portion of the upright container member, and finally through the hollow portion of the upper container member to the pivot rod. The actuator is disposed wholly within the container to prevent damage to the actuator and to facilitate sanitation of the container.

Referring to the drawings and particularly FIG. 1, there is shown a lift top container 10. The container 10 includes a lower container member 12, a plurality of upright container members 42, an upper container member 52, a lid 74, and a foot pedal assembly 84.

In the illustrated example, the lower container member 12 is comprised of the following: a lower front tube 14, a lower rear tube 16, a lower left tube 18, a lower right tube 20, a pair of left and right T fittings 22 and 24, a pair of left and right T fittings 26 and 28, a rear T fitting 30, a pair of left and right four way corner fittings 32 and 34, a pair of front elbow fittings 36 and 38, and a set of four castors 40.

The left hand end of lower front tube 14 (FIG. 1) is received and mounted in a central aperture of left T fitting 22 while the right hand end of lower front tube 14 is received and mounted in a central aperture of right T fitting 24. Left T fitting 22 is slid onto tube 18 and positioned at a forward end thereof. Right T fitting 24 is slid onto tube 20 and positioned at a forward end thereof corresponding to the position of fitting 22 on tube 18. Left T fitting 26 and right T fitting 28 are slid onto tube 18 and tube 20, respectively. Each fitting is positioned in the center of its respective tube exactly opposite each other and a central aperture of fitting 26 and of fitting 28 is aimed vertically.

A rear end of tube 18 is received and mounted in a first corner aperture of four way corner fitting 32. A rear end of tube 20 is received and mounted in a first corner aperture of four way corner fitting 34 in such a manner so as to mirror the connection of fitting 32 to tube 18. Rear T fitting 30 is slid onto rear tube 16 and positioned in the center thereof. Rear tube 16 is then received and mounted in a second corner aperture of four way corner fitting 32 and to a second corner aperture of the four way corner fitting 34 to form the rectangular shaped lower container member 12.

The forward end of the tube 18 is received and mounted in an end aperture of left elbow fitting 36. First castor **40*a* is received and mounted in a second end aperture of left elbow fitting 36. The forward end of tube 20 is received and mounted in an end aperture of right elbow fitting 38. Second castor 40*b* is received and mounted in a second end aperture of right elbow fitting 38. Third castor 40c is received and mounted in a lower aperture of corner fitting 32 and the fourth castor 40d is received and mounted in a lower aperture of corner fitting 34 whereby the lower container member 12 is supported by the castors 40**.

The illustrated upright container members 42 (FIG. 1) are comprised of 4 upstanding hollow tubes comprising: a left front upright tube 44, a right front upright tube 46, a left rear upright tube 48, and a right rear upright tube 50. Tube 44 is received and mounted in lower container member 12 by connecting a lower end of tube 44 with the vertically aimed central aperture of fitting 26. Tube 46 is received and mounted in the lower container member 12 by connecting a lower end of tube 46 with the vertically aimed central aperture of fitting 28 so that tube 44 and tube 46 each extend vertically and in parallel fashion from the lower container member 12. Tube 48 is received and mounted in the lower container member 12 by connecting a lower end of tube 48 with the upper aperture of four way corner fitting 32. Tube 50 is received and mounted in the lower container member 12 by connecting a lower end of tube 50 with the upper aperture of four way corner fitting 34 so that tube 48 and tube 50 each extend vertically and in parallel fashion from the lower container member 12.

The illustrated upper container member 52 (FIG. 1) is comprised of the following: an upper front tube 54, a three part upper rear tube 56, an upper left tube 58, an upper right tube 60, a pair of elbow fittings 62 and 64, a pair of T fittings 66 and 68, a pair of three corner fittings 70 and 72, a pivot tube 78 and a pair of pivot tube rotation screws 80.

Figure 2:
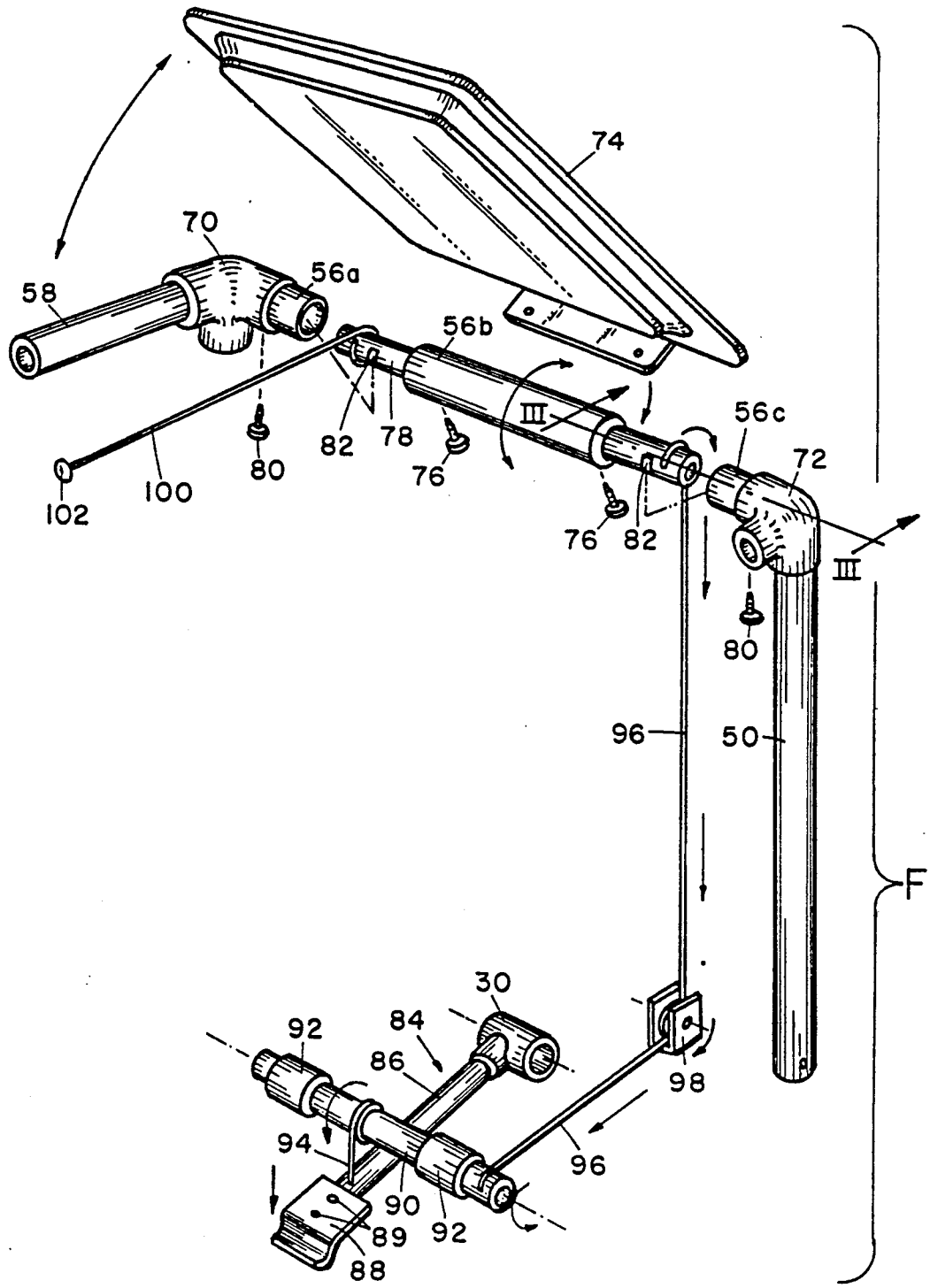
FIG. 2 is a fragmentary exploded view of the container particularly showing integrated lid and foot pedal actuator mechanisms.
Figure 3:
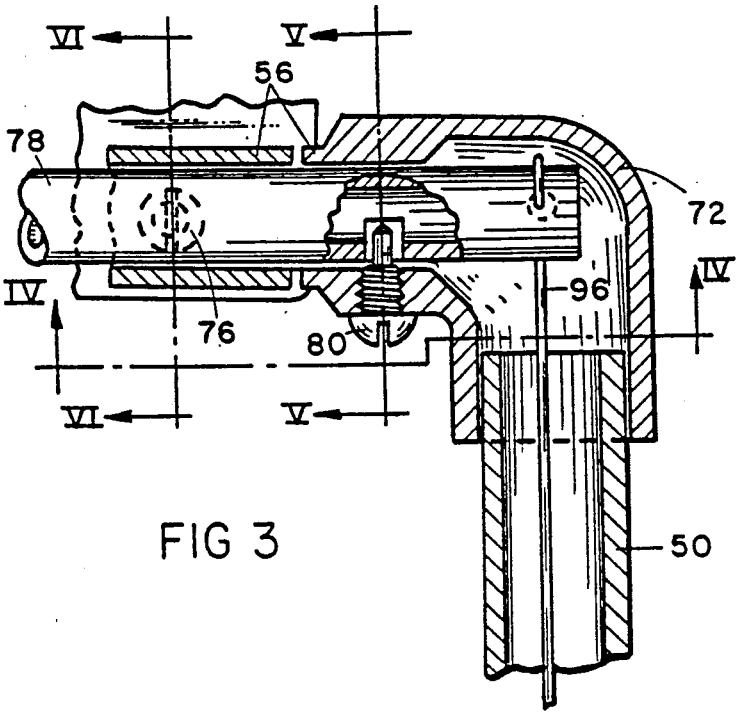
FIG. 3 is a fragmentary cross-sectional view of the integrated lid actuator mechanism.
Figure 5:
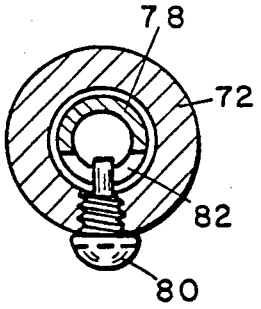
FIG. 5 is a cross-sectional view of the integrated lid actuator mechanism taken along the line V—V of FIG. 3, and showing a pivot tube rotation control screw.
Figure 6:
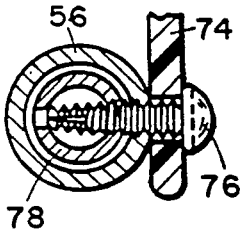
FIG. 6 is a cross-sectional view of the integrated lid actuator mechanism, taken along the line VI—VI of FIG. 3, and showing a lid attachment screw.
Figure 4:
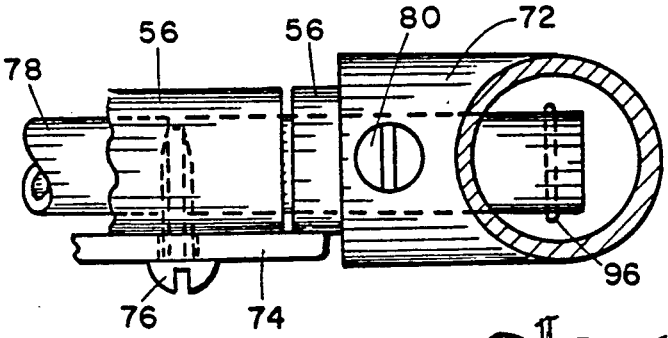
FIG. 4 is a cross-sectional view of the integrated lid actuator mechanism, taken along the line IV—IV of FIG. 3.
Figure 7:
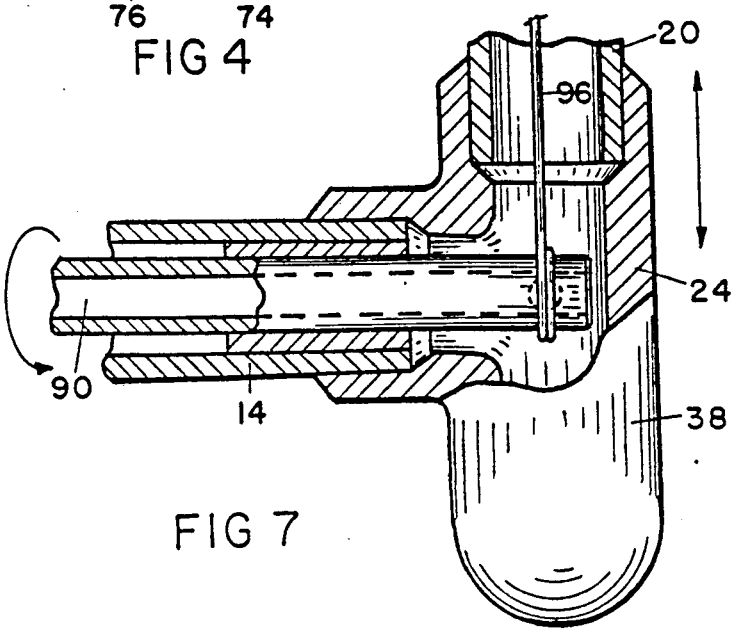
FIG. 7 is a fragmentary top plan view of the container, with portions thereof broken away to show the torque transmission tube and associated parts.
Figure 8:
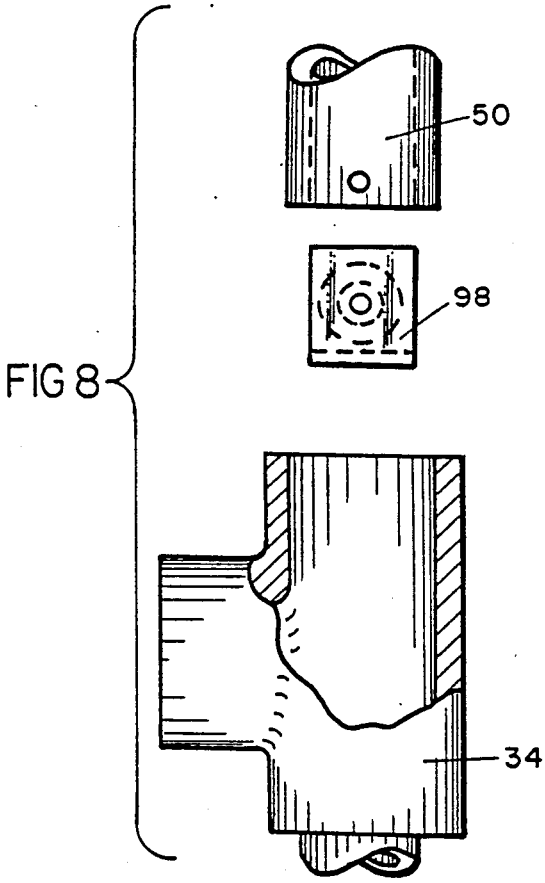
FIG. 8 is an exploded view of a idler tube portion of the container, with portions thereof broken away to reveal internal construction.
Figure 9:
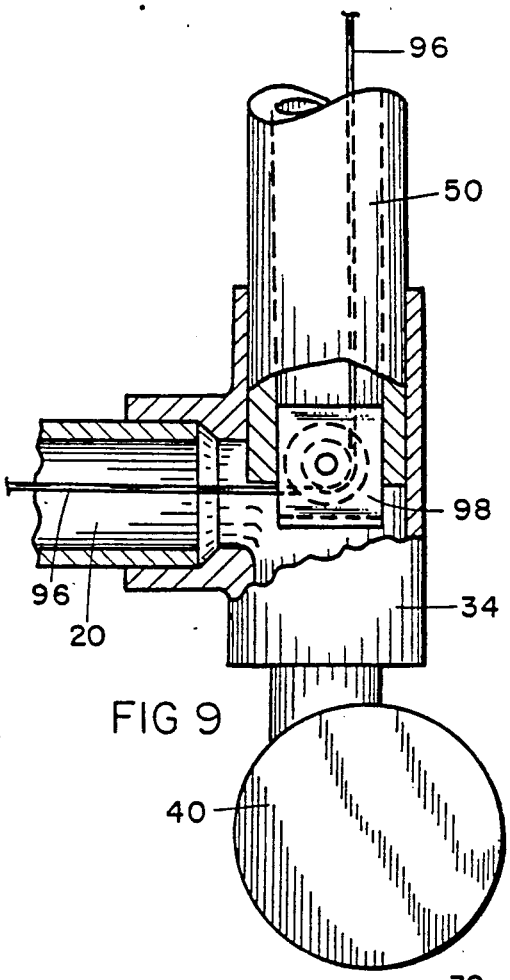
FIG. 9 is a cross-sectional view of the idler pulley.
Figure 10:
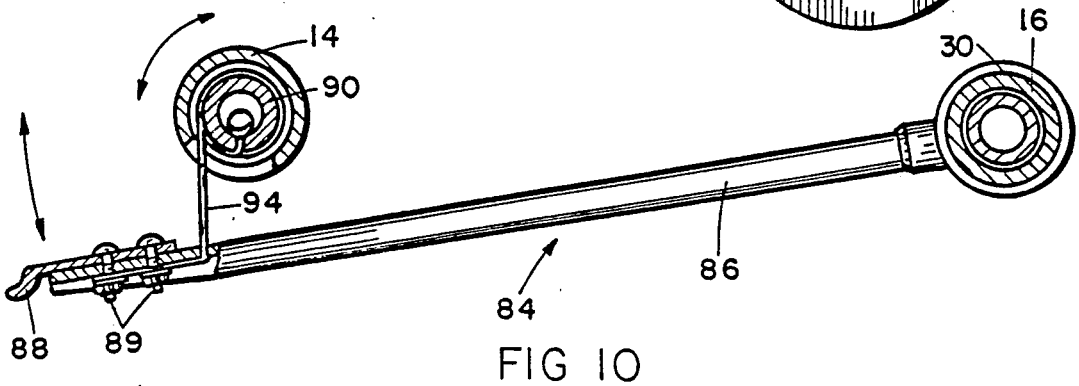
FIG. 10 is a cross-sectional view of a foot pedal assembly portion of the container.

The upper ends of tubes 48 and 50 are attached to three corner fittings 70 and 72, respectively. Similarly, the upper ends of tubes 44 and 46 are attached to a central aperture of T fitting 66 and 68, respectively. Upper left tube 58 is slid through T fitting 66 and the rear end of tube 58 is received and mounted in an aperture of three corner fitting 70. In parallel to upper left tube 58, upper right tube 60 is slid through T fitting 68 and the rear end of tube 60 is received and mounted in an aperture of three corner fitting 72. Elbow fitting 62 is received and mounted in the forward end of tube 58 and elbow fitting 64 is received and mounted in the forward end of tube 60. Elbow fittings 62 and 64 are then connected by means of upper front tube 54. Pivot tube 78 (FIG. 2) serves to connect three corner fitting 70 with three corner fitting 72 by means of a pair of pivot tube rotation control screws 80 which pierce the undersides of fittings 70 and 72. Pivot tube 78 has a pair of slots 82 melted into the tube at each end which accept the screws 80. The slots 82 allow pivot tube 78 to rotate without disrupting the structural integrity of the upper container member 52.

Upper rear tube 56 actually consists of three parts: a left end 56a received and mounted in fitting 70; a freely rotatable center part 56b fixedly attached to pivot tube 78; and a right end 56c received and mounted in fitting 72. The three parts of upper rear tube 56 enclose virtually the entire pivot tube 78. The only portions of pivot tube 78 left uncovered are seams 56d and 56e. These seams allow the free rotation of the rear tube center part 56b in cooperation with the rotation of pivot tube 78. Lid 74 is connected to rear tube center part 56b by means of a pair of lid attachment screws 76. Lid attachment screws 76 pierce rear tube center part 56b to attach lid 74 to pivot tube 78. Lid 74 rotates with pivot tube 78 and rear tube center part 56b. Seams 56d and e are covered by lid 74 so that pivot tube 78 has minimum exposure to contaminating elements.

On the present example, foot pedal assembly 84 (FIG. 2) consists of T fitting 30, a foot pedal tube 86 and a foot pedal tread 88. Foot pedal tube 86 is received and mounted in a central aperture of T fitting 30. Foot pedal tube 86 is angled obliquely downwardly from rear tube 16 so as to pass underneath front tube 14. Foot pedal tread 88 is connected to the forward, foot pedal tube 86 by suitable fastening means such as the illustrated pair of screws 89. A torque transmission tube 90 is located within lower front tube 14. A pair of torque transmission tube bearings 92 are connected to torque transmission tube 90 to facilitate rotation of torque transmission tube 90 within front tube 14.

A flexible actuator system 93 operatively connects foot pedal assembly 84 with lid 74 such that the depression of foot pedal assembly 84 opens lid 74. In the illustrated example, flexible actuator system 93 includes a first cable 94, a second cable 96 and an elastomeric cable 100. First cable 94 connects foot pedal assembly 84 with torque transmission tube 90 in such a manner so that actuation of foot pedal assembly 84 causes counterclockwise rotation of torque transmission tube 90 while second cable 96 connects torque transmission tube 90 with pivot tube 78 in such a manner such that counterclockwise rotation of torque transmission tube 90 causes clockwise rotation of pivot tube 78. Second cable 96, which is connected to torque transmission tube 90 at a point within T fitting 24, travels through lower right tube 20 to four way corner fitting 34. An idler pulley 98 located within the first end of right rear upright tube 50 causes second cable 96 to make a 90 turn and travel vertically through right rear upright tube 50 to connect with pivot tube 78 within three corner fitting 72. Elastomeric cable 100 connects pivot tube 78 to a stop 102 so as to cause automatic closure of lid 74 upon release of foot pedal assembly 84. Elastomeric cable 100 also serves to provide the flexible actuator system with a degree of tension so that the container may be operated silently.

Figure 11:
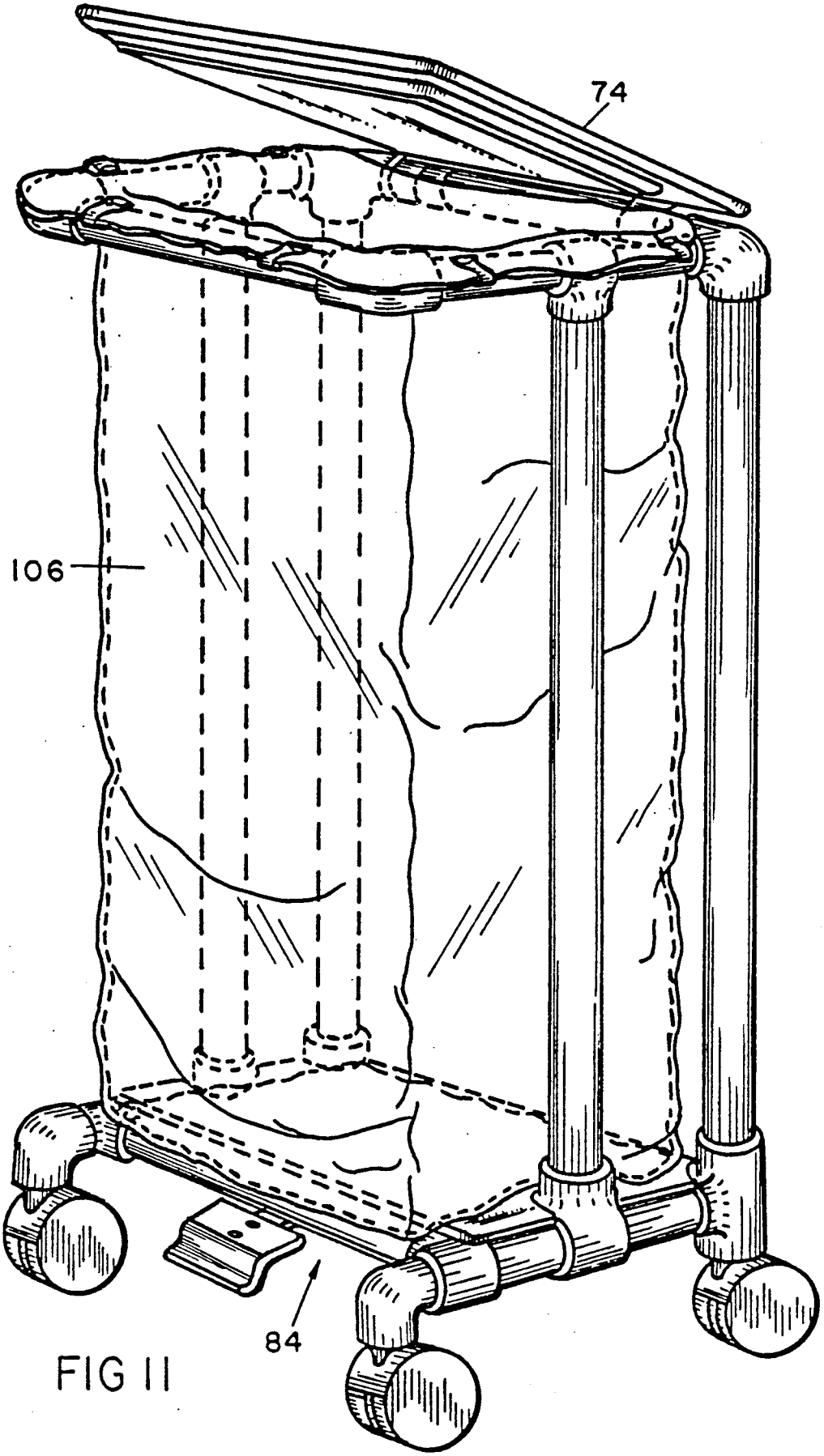
FIG. 11 is a perspective view of the lift top container embodying the present invention supporting a flexible refuse receptacle.

A removable cart bottom 104 may optionally be placed on top of the lower container member 12. Container 10 is designed to support a refuse receptacle 106, which may be rigid or flexible. A flexible refuse receptacle 106 (FIG. 11) is supported by container 10 by means of a set of snaps 108 attached to upper frame member 52. A rigid refuse receptacle 106' (not shown) is supported by container 10 by means of cart bottom 104.

In operation, a downward force on foot pedal tread 88 in the direction of the arrows in FIG. 1 causes foot pedal tube 86 to move downwardly. This downward movement of foot pedal member 86 causes first cable 94 to unwind from its wrapped condition on torque transmission tube 90. This unwinding of first cable 94 from torque transmission tube 90 causes a counterclockwise rotation of torque transmission tube 90. The counterclockwise rotation of torque transmission tube 90 causes second cable 96 to begin wrapping around the portion of torque transmission tube 90 located within T fitting 24. The winding of second cable 96 around torque transmission tube 90 causes second cable 96 to unwind from its wrapped condition on pivot tube 78. This unwinding of second cable 96 from pivot tube 78 causes pivot tube 78 to rotate clockwise. This clockwise rotation of pivot tube 78 causes lid 74 to open from its normally closed position on upper container member 52. The clockwise rotation of pivot tube 78 also causes elastomeric cable 100 to stretch and wrap around pivot tube 78. The rotation of pivot tube 78 is checked by the presence of pivot tube rotation control screws 80 when the screws 80 reach the limit of rotation allowed by milled slots 82. Lid 74 is closed by gravity action as well as the biasing action of elastomeric cable 100. Fitting 30 of foot pedal assembly 84 is capable of rotation around lower rear member 16. Idler pulley 98 allows the direction of cable 96 to change without rubbing and causing excessive friction. Idler pulley 98 allows the force necessary to open lid 74 to be transmitted from torque transmission tube 90 to pivot tube 78.

The mechanism of the present invention keeps all parts internal which greatly facilitates the maintaining of cleanliness. The invention also allows the container to be a self-contained unit because it is easily transported between different locations. This also facilitates the maintaining of cleanliness. The invention further provides for the ability to engineer the container to precise human factors. The foot pedal is capable of being placed at a number of locations and at the proper angle relative to the floor and the cart so that the foot motion required to open the lid is easy and natural because the heel of the foot is allowed to remain on the floor. With proper selection of the tube diameters, the foot pedal motion and force required to open the lid can be designed to be appropriate for a natural feel and motion.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are as follows.

I claim:

1. A treadle top container support for refuse and the like, comprising:

a lower container member shaped to support said container support on a floor surface, and having a tubular portion therein;

an upper container member shaped to define an open marginal edge through which articles pass into and out of said container support, and having a tubular portion therein;

an upright container member interconnecting said lower container member and said upper container member, and including a tubular portion therein with opposite ends thereof communicating with the tubular portion of said lower container member and the tubular portion of said upper container member;

a foot pedal movably mounted adjacent said lower container member for shifting between first and second positions;

a lid movably mounted adjacent said upper container member; said lid being shaped to selectively close the open marginal edge of said upper container member, and adapted to move with respect to said upper container member between open and closed positions; and a flexible actuator, having one end thereof operatively connected with said lid, and the other end thereof operatively connected with said foot pedal, and being configured such that shifting said foot pedal between said first and second positions moves said lid between said open and closed positions; said actuator extending continuously from said foot pedal through the tubular portion of said lower container member, through the tubular portion of said upright container member, and through the tubular portion of said upper container member to said lid, whereby said actuator is disposed substantially wholly within said container support to prevent damage to said actuator, and facilitate sanitation of said container.

2. A container support as set forth in claim 1, wherein:

said tubular portion of said upright container member is oriented at a preselected angle with respect to at least one of said upper container tubular member and said lower container tubular member; and including:

a bearing disposed generally between said upright container tubular portion and said one of said upper container tubular member and said lower container tubular member, supportingly engaging an associated portion of said actuator to facilitate longitudinal motion thereof with the tubular portions of said container.

3. A container support as set forth in claim 2, wherein:

said lid is pivotally mounted on a rearward portion of said upper container member.

4. A container support as set forth in claim 3, wherein:

said foot pedal is positioned adjacent a central portion of said lower container member, and protrudes forwardly therefrom to facilitate pedal operation.

5. A container support as set forth in claim 4, wherein:

said lower container member, said upright container member and said upper container member are configured to define an open frame; and including:

a receptacle removably supported in said frame.

6. A container support as set forth in claim 5, wherein:

said receptacle comprises a flexible bag; and including:

means for supporting said bag suspended from said upper container member.

7. A container support as set forth in claim 1, wherein:

said lid is pivotally mounted on a rearward portion of said upper container member.

8. A container support as set forth in claim 7, wherein:

said foot pedal is positioned adjacent a central portion of said lower container member, and protrudes forwardly therefrom to facilitate pedal operation.

9. A container support as set forth in claim 8, wherein:

said lower container member, said upright container member and said upper container member are configured to define an open frame; and including:

a receptacle removably supported in said frame.

10. A container support as set forth in claim 9, wherein:

said receptacle comprises a flexible bag; and including:

means for supporting said bag suspended from said upper container member.

11. A container support as set forth in claim 1, wherein:

said foot pedal is positioned adjacent a central portion of said lower container member, and protrudes forwardly therefrom to facilitate pedal operation.

12. A container support as set forth in claim 11, wherein:

said lower container member, said upright container member and said upper container member are configured to define an open frame; and including:

a receptacle removably supported in said frame.

13. A container support as set forth in claim 12, wherein:

said receptacle comprises a flexible bag; and including:

means for supporting said bag suspended from said upper container member.

14. A container support as set forth in claim 1, wherein:

said lower container member, said upright container member and said upper container member are configured to define an open frame; and including:

a receptacle removably supported in said frame.

15. A container support as set forth in claim 14, wherein:

said receptacle comprises a flexible bag; and including:

means for supporting said bag suspended from said upper container member.

16. A container support as set forth in claim 1, wherein:

said lower container member, said upright container member and said upper container member are configured to define an open frame; and including:

a flexible bag receptacle supported in said frame.

17. A lift top container for refuse and the like, comprising:

a lower container member shaped to support said container on a floor surface, and having a tubular portion therein;

an upper container member shaped to define an open marginal edge through which articles pass into and out of said container;

said upper container member having a tubular portion therein, and including at least first and second segments spaced laterally apart a preselected distance at a predetermined position on said upper container member;

an upright container member interconnecting said lower container member and said upper container member, and including a tubular portion therein with opposite ends thereof communicating with the tubular portion of said lower container member and the tubular portion of said upper container member;

a foot pedal movably mounted adjacent said lower container member for shifting between first and second positions;

a lid shaped to selectively close the open marginal edge of said upper container member;

a pivot rod rotatably mounting said lid on said upper container member for pivoting said lid between open and closed positions; said pivot rod being fixedly connected with said lid for rotation therewith, and having opposite ends thereof disposed adjacent to the first and second segments of said upper container member;

means for connecting the opposite ends of said pivot rod with said first and second container segments in a manner which permits said pivot rod and said lid to rotate between the open and closed positions, yet laterally interconnects the first and second segments of said upper container member to provide structural rigidity to said container; and a flexible actuator, having one end thereof operatively connected with said pivot rod, and the other end thereof operatively connected with said foot pedal, and being configured such that shifting said foot pedal between said first and second positions rotates said pivot rod and moves said lid between said open and closed positions; said actuator extending continuously from said foot pedal through the tubular portion of said lower container member, through the tubular portion of said upright container member, and through the tubular portion of said upper container member to said pivot rod, whereby said actuator is disposed substantially wholly within said container to prevent damage to said actuator, and facilitate sanitation of said container.

18. A container as set forth in claim 17, wherein:

said tubular portion of said upright container member is oriented at a preselected angle with respect to at least one of said upper container tubular member and said lower container tubular member; and including:

a bearing disposed generally between said upright container tubular portion and said one of said upper container tubular member and said lower container tubular member, supportingly engaging an associated portion of said actuator to facilitate longitudinal motion thereof within the tubular portions of said container.

19. A treadle top container for refuse and the like, comprising:

a lower container member shaped to support said container on a floor surface, and having a tubular portion therein;

means for receiving and retaining refuse therein;

an upper container member shaped to define an o pen marginal edge through which articles pass into and out of said refuse retaining means, and having a tubular portion therein;

an upright container member interconnecting said lower container member and said upper container member, and including a tubular portion therein with opposite ends thereof communicating with the tubular portion of said lower container member and the tubular portion of said upper container member;

a foot pedal movably mounted adjacent said lower container member for shifting between first and second positions;

a lid movably mounted adjacent said upper container member; said lid being shaped to selectively close the open marginal edge of said upper container member, and adapted to move with respect to said upper container member between open and closed positions; and a flexible actuator, having one end thereof operatively connected with said lid, and the other end thereof operatively connected with said foot pedal, and being configured such that shifting said foot pedal between said first and second positions moves said lid between said open and closed positions; said actuator extending continuously from said foot pedal through the tubular portion of said lower container member, through the tubular portion of said upright container member, and through the tubular portion of said upper container member to said lid, whereby said actuator is disposed substantially wholly within said container to prevent damage to said actuator, and facilitate sanitation of said container.

* * * * *